US005803099A

United States Patent [19]

Sakuta et al.

[11] Patent Number: 5,803,099

[45] Date of Patent: Sep. 8, 1998

[54] ULTRASONIC CLEANING MACHINE

[75] Inventors: Shinichi Sakuta; Genzi Mori, both of Kobe; Toyoki Sasakura, Ashiya; Yukio Morimoto, Kobe, all of Japan

[73] Assignees: Matsumura Oil Research Corp.; Furuno Electric Co., Ltd., both of Nishinomiya, Japan

[21] Appl. No.: 557,633

[22] Filed: Nov. 14, 1995

[30] Foreign Application Priority Data

Nov. 14, 1994 [JP] Japan ..... 6-279480

[51] Int. Cl.[6] ..... B08B 3/10

[52] U.S. Cl. ..... 134/56 R; 134/58 R; 134/184; 134/105; 310/335; 68/355

[58] Field of Search ..... 134/56 R, 57 R, 134/58 R–184, 105; 310/315, 341, 346, 335; 236/1 F; 68/355

[56] References Cited

U.S. PATENT DOCUMENTS

| | | | |
|---|---|---|---|
| 1,734,975 | 11/1929 | Loomis et al. | 68/355 |
| 1,875,953 | 9/1932 | Taylor | 310/341 |
| 2,163,650 | 6/1939 | Weaver | 310/341 |
| 2,257,997 | 10/1941 | Barnes | 68/355 |
| 2,407,462 | 9/1946 | Whiteley | 68/355 |
| 2,468,537 | 4/1949 | Benioff | 366/127 |
| 2,616,820 | 11/1952 | Bourgeaux | 134/184 |
| 2,779,695 | 1/1957 | Brown | 134/1 |
| 2,828,231 | 3/1958 | Henry | 68/355 |
| 2,845,077 | 7/1958 | Branson | 134/1 |
| 2,855,526 | 10/1958 | Jones | 310/341 |
| 2,891,176 | 6/1959 | Branson | 134/1 |
| 2,950,725 | 8/1960 | Jacke et al. | 134/184 |
| 2,970,073 | 1/1961 | Prnage | 134/1 |
| 2,974,070 | 3/1961 | Van Dongeren | 134/1 |
| 2,992,142 | 7/1961 | Kearney | 134/1 |
| 3,098,370 | 7/1963 | Poole et al. | 68/355 |
| 3,117,768 | 1/1964 | Carlin | 134/1 |
| 3,318,578 | 5/1967 | Brabson | 134/1 |
| 3,387,607 | 6/1968 | Gauthier et al. | 310/335 |
| 3,481,687 | 12/1969 | Fishman | 134/1 |
| 3,553,602 | 1/1971 | Brothers et al. | 310/341 |
| 4,001,766 | 1/1977 | Hurwitz | 310/335 |
| 5,063,322 | 11/1991 | Sugita | 310/341 |
| 5,074,322 | 12/1991 | Jaw | 134/56 R |
| 5,137,580 | 8/1992 | Honda | 134/1 |
| 5,446,954 | 9/1995 | Knecht et al. | 310/315 |

FOREIGN PATENT DOCUMENTS

| | | | |
|---|---|---|---|
| 1036602 | 8/1958 | Germany | 134/184 |
| 62-281431 | 12/1987 | Japan | 134/1 |
| 636049 | 12/1978 | U.S.S.R. | 134/1 |

*Primary Examiner*—Frankie L. Stinson
*Attorney, Agent, or Firm*—Jordan and Hamburg

[57] ABSTRACT

The present invention provides flexibility in the shape and material of the cleaning vessel, enables high-power transmission of ultrasonic waves, and reduces audible noise generation. An ultrasonic cleaning machine according to the invention comprises an acoustic lens mounted above an ultrasonic transducer which is immersed in oil held within an external tank as well as a cleaning vessel holding a cleaning liquid further above the acoustic lens so that ultrasonic waves produced by the ultrasonic transducer converge at a point within the cleaning liquid. In one form of the invention, the cleaning vessel is eliminated and the cleaning liquid is held directly in the external tank.

4 Claims, 11 Drawing Sheets

ULTRASONIC CLEANING MACHINE

FIELD OF THE INVENTION

This invention relates to an ultrasonic cleaning machine.

DESCRIPTION OF THE PRIOR ART

FIG. 1 is a general configuration diagram showing a typical example of conventional ultrasonic cleaning machines. An oscillating circuit 3 generates a 28 kHz signal, for instance. This signal is amplified by a power amplifier 4 to cause an increase and converted into ultrasonic vibration by ultrasonic transducers 5 that are attached to the bottom of a cleaning vessel 53 from underside. (It is to be noted that although there is shown only a single array of transducers 5 in FIG. 1, they are actually attached to the whole bottom surface of the cleaning vessel 53.) The ultrasonic vibration produced by the ultrasonic transducers 5 penetrates the cleaning vessel 53 and propagates to a cleaning liquid X held in the cleaning vessel 53. If an object to be cleaned is immersed in the cleaning liquid X, ultrasonic waves hit its surface and resultant cavitation and/or ultrasonic streaming removes dirt from the surface of the object.

Although ferrite was conventionally used in producing vibrating elements 5-1 of the ultrasonic transducers 5, the use of ceramics is most popular today. Generally, the individual vibrating elements 5-1 are bolted to appropriate support members and bonded to the bottom of the cleaning vessel 53 with epoxy adhesive Q. The cleaning vessel 53 is usually made of stainless steel to prevent corrosion.

The aforementioned conventional ultrasonic cleaning machines have some common problems, which are given below:

(1) The cleaning vessel 53 is limited in its shape and materials. Since the ultrasonic transducers 5 are directly adhered to the bottom of the cleaning vessel 53, the cleaning vessel 53 must have a flat bottom and its material is limited to metal. For this reason, it is practically impossible to use a tank of a complex shape made of molded resin, for example.

(2) Transmitted ultrasonic energy is limited in its level. To obtain high cleaning effect, it is necessary to increase the level of ultrasonic energy incident upon a unit surface area of an object to be cleaned. It is, however, impossible to drive the ultrasonic transducers 5 with such high power that exceeds their tolerable level because excessive input power can cause heat generation or a breakdown of the ultrasonic transducers 5.

(3) Bonded surfaces of the ultrasonic transducers 5 can deteriorate due to heat generation and vibration. When affected by heat and vibration, the layer of adhesive Q which holds the ultrasonic transducers 5 to the bottom of the cleaning vessel 53 may break, allowing the transducers 5 to come off.

(4) Dirt adhering to fingers and fingernail s is difficult to remove. When hit by ultrasonic waves, human nerves and bones suffer a severe pain or an unpleasant feeling. If a hand is exposed to ultrasonic waves in the cleaning vessel 53, one would scarcely have any unpleasant feeling in his or her fingertips or fingernails, but a severe pain would occur in the palm and back of the hand. This is because the ultrasonic vibration propagates in the form of progressive waves from the ultrasonic transducers 5 mounted on the bottom of the cleaning vessel 53 and hits the whole surface of the hand soaked in the cleaning liquid X held in the cleaning vessel 53. It is therefore essential to control the input power fed into the ultrasonic transducers 5 to such a level that will not cause pains to human hands. This is likely to result in an inability to provide sufficient cleaning effect.

(5) Unpleasant noise is generated when an ultrasonic cleaning machine is operated. Although ultrasonic waves for exciting the ultrasonic transducers 5 have, frequencies higher than the audible range, it is known that the ultrasonic cleaning machine generates a high-pitched sound which is quite unpleasant to the human ear. This noise results from secondary vibration of the cleaning vessel 53 within the audible frequency range. The noise occurs because vibrating surfaces of the ultrasonic transducers 5 are directly bonded to the metallic surface of the cleaning vessel 53.

SUMMARY OF THE INVENTION

Having summarized an example of the conventional ultrasonic cleaning machine, it is an object of the present invention to solve the above-described problems of the prior art.

According to one aspect of the invention, an ultrasonic cleaning machine comprises an external tank holding an insulating oil, an ultrasonic transmitting and converging device immersed in the insulating oil, and a cleaning vessel holding a cleaning liquid, the cleaning vessel being partially submerged in the insulating oil, wherein ultrasonic waves produced by the ultrasonic transmitting and converging device converge at a single point within the cleaning liquid.

In thus constructed ultrasonic cleaning machine, the cleaning vessel is so located that the ultrasonic waves converge within the cleaning liquid. When an object to be cleaned is positioned at the converging point, ultrasonic energy incident upon a unit surface area of the object is increased and a maximum cleaning effect is obtained. If viscosity of the insulating oil is affected by its temperature variations to a large extent, the ultrasonic cleaning machine may additionally be provided with a power controller and a temperature sensor for controlling output power in order to maintain a constant cleaning effect.

In one form of the invention, the ultrasonic transmitting and converging device of the above ultrasonic cleaning machine includes an ultrasonic transducer and an acoustic lens. The acoustic lens may be mounted either at a certain height above or in close contact with a radiating surface of the ultrasonic transducer. In the former case, it is possible to move up and down the converging point of the ultrasonic waves although there is the need for a support mechanism for retaining the acoustic lens in the insulating oil. In the latter case, mechanical construction can be simplified because such a lens support mechanism is not required although the converging point can not be moved.

There may be provided two each ultrasonic transducers and acoustic lenses so that a user can clean both hands at the same time.

Preferably, the ultrasonic cleaning machine further comprises an infrared sensor which serves as a proximity switch, whereby the ultrasonic cleaning machine is automatically activated when approach of a human hand is sensed.

In a varied form of the invention, the ultrasonic transmitting and converging device includes, in place of the aforementioned ultrasonic transducer and acoustic lens, a plurality of small-sized ultrasonic vibrating elements arranged on a concave surface of an array block. This configuration eliminates the need for the expensive acoustic lens.

According to another aspect of the invention, an ultrasonic cleaning machine comprises an external tank holding an insulating oil, an ultrasonic transmitting and converging device immersed in the insulating oil, a cleaning vessel holding a cleaning liquid, the cleaning vessel being partially submerged in the insulating oil, a pair of signal generators for generating signals of two different frequencies which are used to control output power radiated by the ultrasonic transmitting and converging device, and a temperature sensor for sensing temperature of the insulating oil, wherein ultrasonic waves produced by the ultrasonic transmitting and converging device converge at a single point within the cleaning liquid, and wherein the signals of the two different frequencies for driving an ultrasonic transducer are alternately chosen based on a duty ratio set in accordance with oil temperature to provide a constant cleaning effect regardless of oil temperature variations.

With this arrangement, the ultrasonic transducer is driven at alternately switch ed two frequencies, of which duty ratio is determined in accordance with oil temperature. This frequency switching technique makes it possible to vary the level of cleaning effect over a remarkably wide range in a stable manner.

According to a further aspect of the invention, an ultrasonic cleaning machine comprises an external tank holding an cleaning liquid, and an ultrasonic transducer of which lead wire terminals are insulated with an insulating material having good thermal conductivity, the ultrasonic transducer being immersed in the cleaning liquid, wherein ultrasonic waves produced by the ultrasonic transducer converge at a single point within the cleaning liquid.

In this configuration, there is not provided a small-capacity cleaning vessel and the cleaning liquid filled directly in the external tank is used as a propagation medium for the ultrasonic waves as is the case with the conventional type of ultrasonic cleaning machines. Although lead wire terminals of the ultrasonic transmitting and converging device must to be insulated with an insulating material having good heat dissipation efficiency, it is not necessary to use any insulating oil as an ultrasonic propagation medium. Naturally, oil temperature compensation is not required either.

The ultrasonic transmitting and converging device of the this type of ultrasonic cleaning machine may also include an ultrasonic transducer and an acoustic lens. The acoustic lens may be mounted either at a certain height above or in close contact with a radiating surface of the ultrasonic transducer.

As will be recognized from this summary of the invention, the ultrasonic cleaning machine employs an ultrasonic transmitting and converging device, or a combination of an ultrasonic transducer and acoustic lens. With this arrangement, ultrasonic waves can be converged at an appropriate position within the cleaning liquid to increase ultrasonic energy incident upon a unit surface area of an object to be cleaned. It is therefore possible to obtain a desired level of cleaning effect without entering excessive power into any ultrasonic vibrating element. Because the radiating surface of the transducer or the ultrasonic transmitting and converging device is not in direct contact with the external tank, audible noise generation is extremely small. Furthermore, since the transducer, or the ultrasonic transmitting and converging device, lies within an insulating oil or a molding resin, or a combination of both, heat resulting from ultrasonic wave generation is effectively dissipated so that the risk of overheating is minimized.

Other objects, features and advantages of the invention will be more fully understood upon reading the detailed description of the preferred embodiments to follow in conjunction with the accompanying drawings, in which like reference numerals designate like elements.

BRIEF DESCRIPTION OF THE DRAWINGS

FIG. 15 is a perspective view showing a seventh embodiment of the invention.

DETAILED DESCRIPTION OF THE PREFERRED EMBODIMENTS

Figure 1:
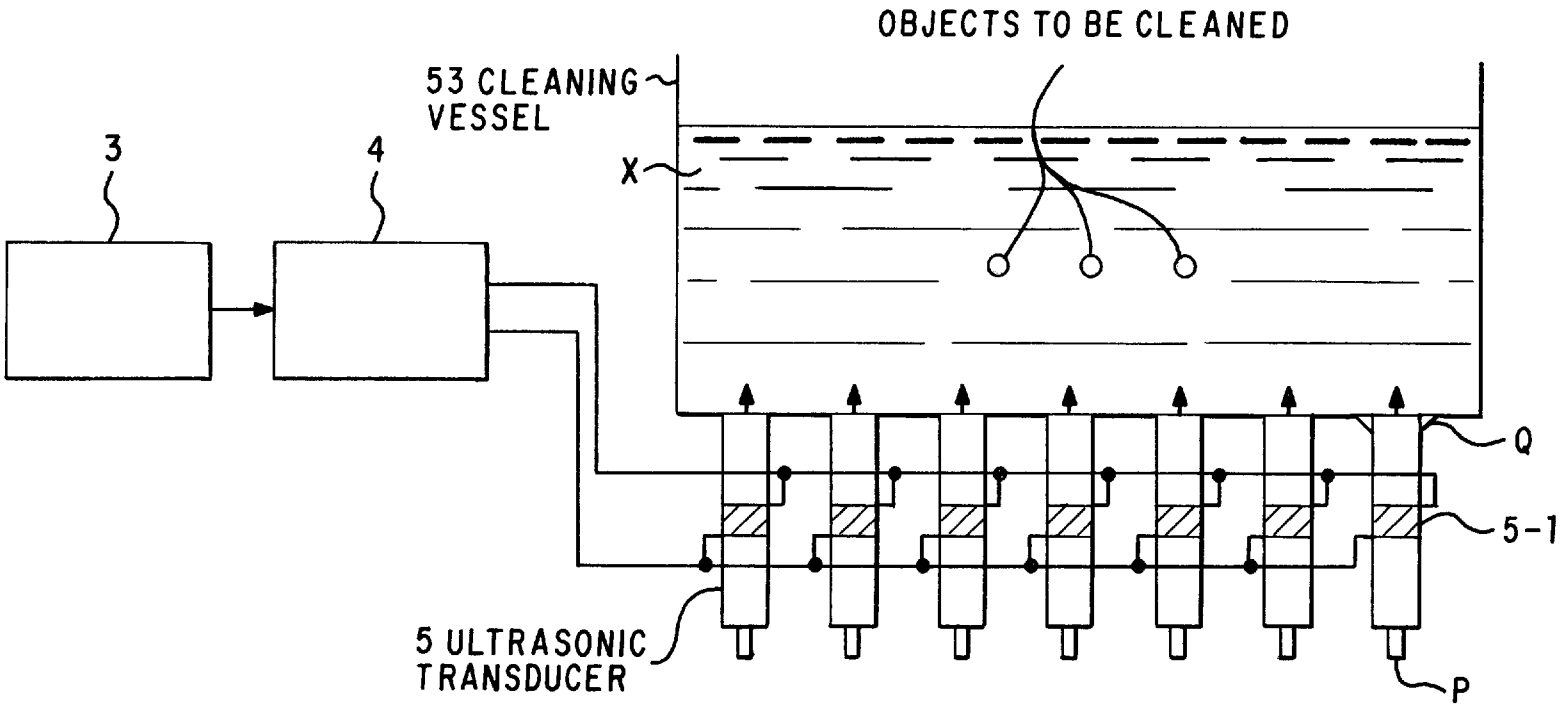
FIG. 1 is a general configuration diagram of a conventional ultrasonic cleaning machine.
Figure 2:
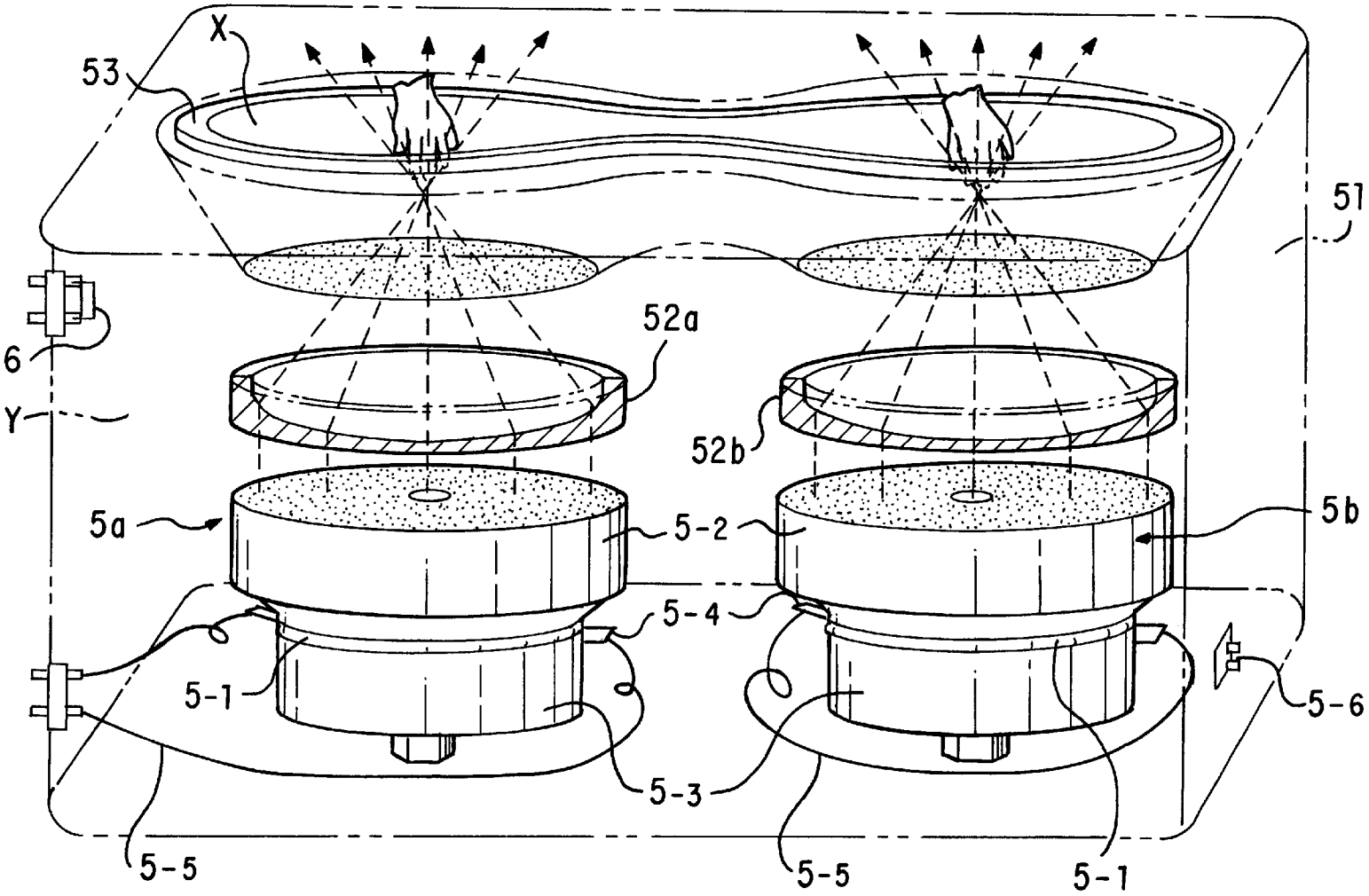
FIG. 2 is a perspective view schematically illustrating the internal construction of an ultrasonic cleaning machine according to a first embodiment of the present invention.

FIG. 2 is a perspective diagram showing the general internal construction of an ultrasonic cleaning machine according to a first embodiment of the invention. A pair of ultrasonic transducers 5 (5*a*, 5*b*) are fixed to the inside bottom surface of an external tank 51 via vibration-isolating members. Each ultrasonic transducer 5 (5*a*, 5*b*) comprises a vibrating element 5-1 and appropriate metallic matching elements 5-2 and 5-3 that are bonded to the top and bottom sides of the vibrating element 5-1 to obtain a desired resonance frequency (28 kHz). A little more than 10 mm above the top surface of each ultrasonic transducer 5 (5*a*, 5*b*), there is provided an acoustic lens 52 (52*a*, 52*b*) for converging ultrasonic waves.

The operation of an acoustic lens is now briefly described. Although the acoustic lens follows well-known Snell's law as does an optical lens, it works in a different way on the following points.

Figure 4:
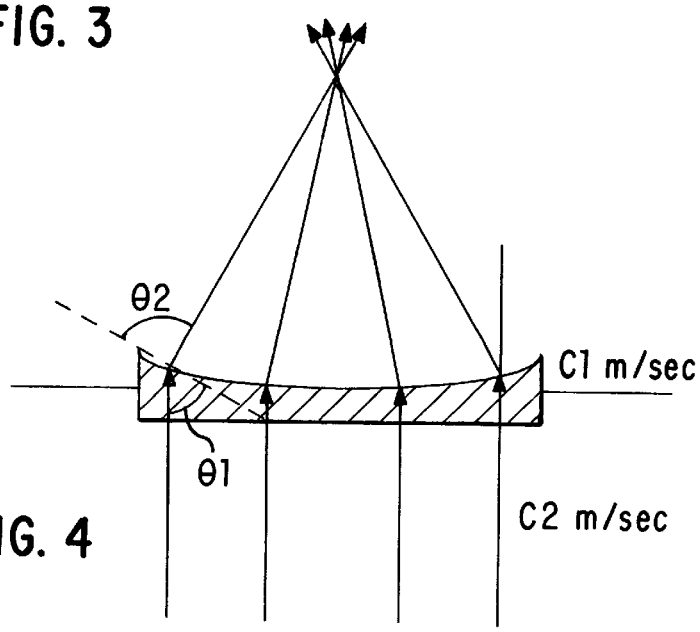
FIG. 4 is a diagram for explaining the behavior of an acoustic lens.

The acoustic lens is usually used in water or other liquid as most of ultrasonic energy incident upon a lens surface is reflected when the acoustic lens is used in the atmosphere. A convex optical lens can still converge a light beam even when it is immersed in water. This is because light waves propagate at a lower velocity in lens body than in water, as is the case when the lens is used in the air. Contrarily, the propagating velocity of sound waves is higher in lens body than in water or air and, therefore, a sound beam is converged by an acoustic concave lens, unlike the case with the optical lens. The aforementioned behavior of the acoustic lens is now described in further detail using Snell's law. Referring to FIG. 4, there is shown an acoustic lens made of an acrylic plate. Here, it is assumed that the sound velocity $C_1$ within the acoustic lens is 2500 m/sec., and the sound velocity $C_2$ in water is 1400 m/sec. If $\theta_1$ is the angle of incidence, and $\theta_2$ the angle of refraction, measured from the interface between the lens and water when sound waves pass from the lens to water, $C_1/C_2=\cos\theta_1/\cos\theta_2$. It is apparent from this equation that $\theta_1<\theta_2$ because $C_1>C_2$. It follows that sound waves passing through the acoustic concave lens at right angles thereto converge as shown in FIG. 4.

Referring again to FIG. 2, there is provided a small-capacity cleaning vessel 53 having a one-piece formed pair of washbowls above the acoustic lenses 52, covering the top of the external tank 51. The cleaning vessel 53 holds a cleaning liquid X which may be water or a solution of detergent while the external tank 51 is filled with insulating oil Y (e.g., mineral oil or synthetic oil) almost to the top surface of the cleaning vessel 53 and hermetically sealed. The ultrasonic transducers 5 and acoustic lenses 52 are therefore completely immersed in the oil Y. A narrow air gap is left above the surface of the oil Y, within the external tank 51. This is to protect the external tank 51 from expansion of the oil Y due to its temperature variations. Shown by the numeral 6 is a thermistor for sensing oil temperature.

The focal length of each acoustic lens 52 (52*a*, 52*b*) is 60 mm in water. If the bottom of the cleaning vessel 53 is positioned 30 mm above the acoustic lenses 52, converging points (or focal points) of ultrasonic waves are located 30 mm above the bottom of the cleaning vessel 53 (since the sound velocity in the cleaning liquid X is almost same as in the oil Y). If the ultrasonic cleaning machine is used as a fingernail cleaner as shown in FIG. 2, the focal points occur approximately at distal interphalangeal joints of human hands when they are soaked in the cleaning vessel 53.

Figure 3:
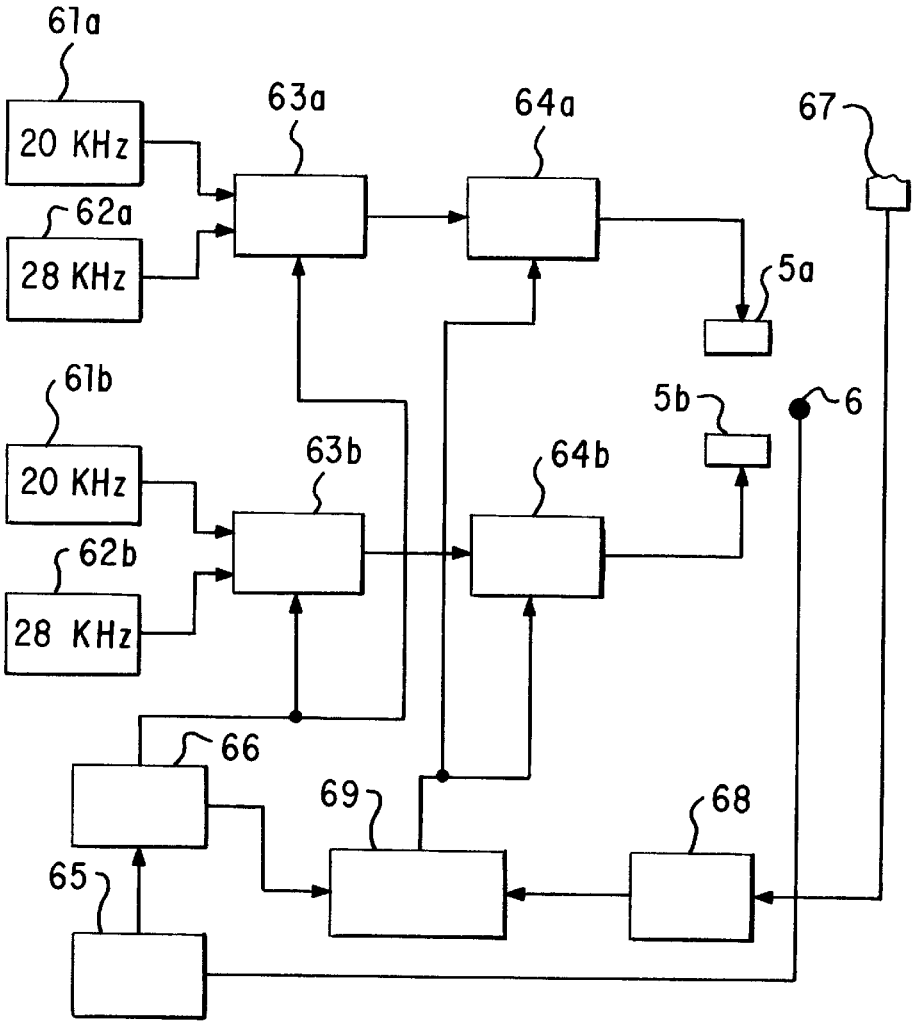
FIG. 3 is a block diagram of a drive/control circuit applicable to the ultrasonic cleaning machine of FIG. 2.

FIG. 3 is a block diagram showing a drive/control circuit for controlling and driving the ultrasonic cleaning machine of FIG. 2.

Designated by the numeral 61 (61*a*, 61*b*) are oscillating circuits for generating a 20 kHz signal (non-resonant frequency); and designated by the numeral 62 (62*a*, 62*b*) are oscillating circuits for generating a 28 kHz signal (resonant frequency). Designated by the numeral 63 (63*a*, 63*b*) are switching circuits for alternately switching between the 20 kHz and 28 kHz signals fed from the respective oscillating circuits 61, 62. More specifically, each switching circuit 63 (63*a*, 63*b*) selects the 28 kHz oscillating circuit 62 (62*a*, 62*b*) when an ON signal is transmitted from a later-described ON time control circuit 66, the 20 kHz oscillating circuit 61 (61*a*, 61*b*) when an OFF signal is transmitted from the ON time control circuit 66. Designated by the numeral 64 (64*a*, 64*b*) are power amplifiers for driving the respective ultrasonic transducers 5 (5*a*, 5*b*). Each power amplifier 64 (64*a*, 64*b*) amplifies the output signal of the 20 kHz oscillating circuit 61 (61*a*, 61*b*) or 28 kHz oscillating circuit 62 (62*a*, 62*b*) whichever selected by the switching circuit 63 (63*a*, 63*b*) when an ON signal is received from a later-described ON/OFF control circuit 69. It is to be noted that the circuits (61*a*, 62*a*, 63*a* and 64*a*) for driving the ultrasonic transducer 5*a* are identical to the circuits (61*b*, 62*b*, 63*b* and 64*b*) for driving the ultrasonic transducer 5*b*. If the ultrasonic cleaning machine is of a single transducer type as in a later-described second embodiment, there should be provided only one set of these circuits.

When an ultrasonic transducer is immersed in oil as is the case with the present embodiment, variations in oil viscosity due to oil temperature changes significantly affect ultrasonic propagating conditions. This has great impact on the cleaning effect. To maintain a constant level of cleaning effect, the ultrasonic cleaning machine of this embodiment is provided with a circuit for oil temperature compensation, which will be described in detail below.

Figure 5:
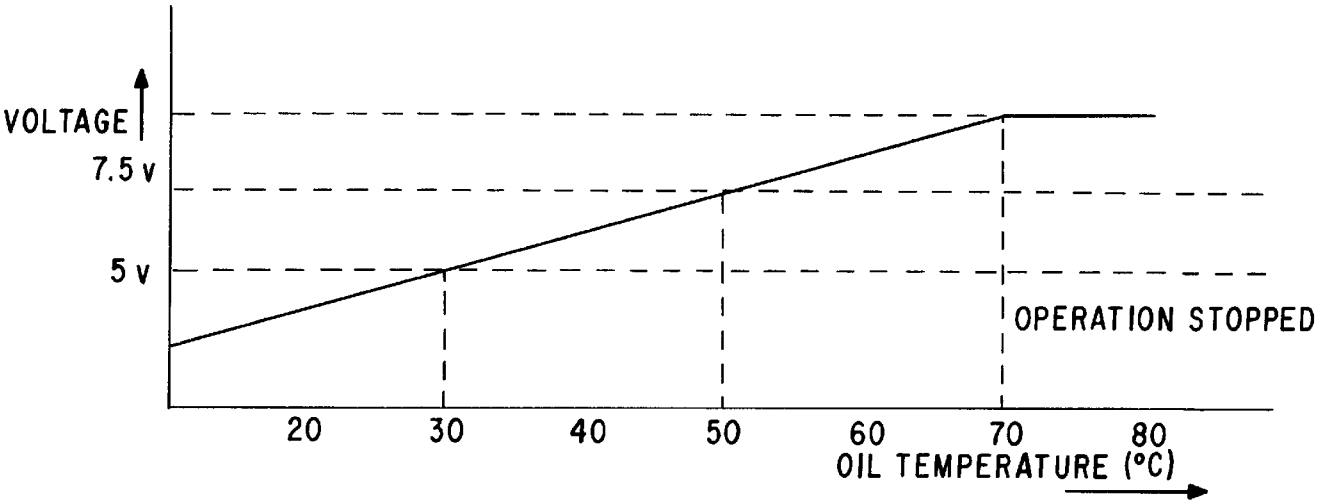
FIG. 5 is a graph showing operating characteristics of a temperature/voltage conversion circuit of FIG. 3.
Figure 6:
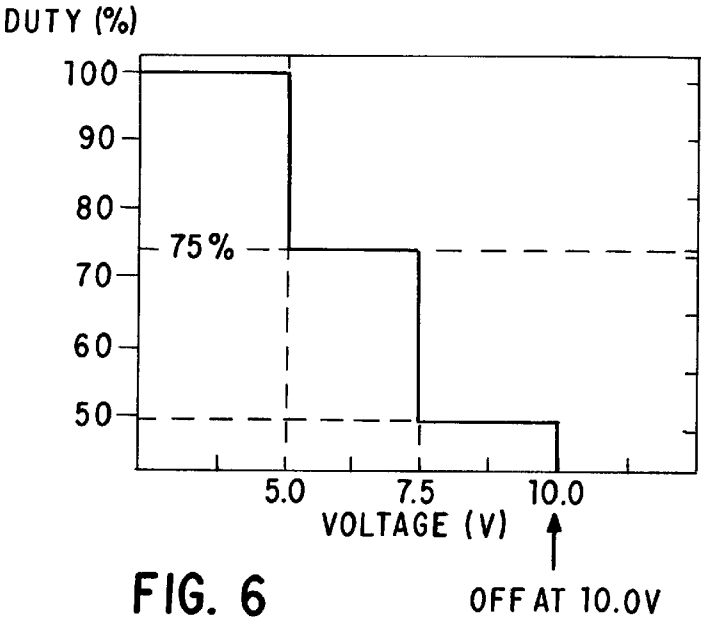
FIG. 6 is a graph showing operating characteristics of an ON time control circuit of FIG. 3.
Figure 7A:
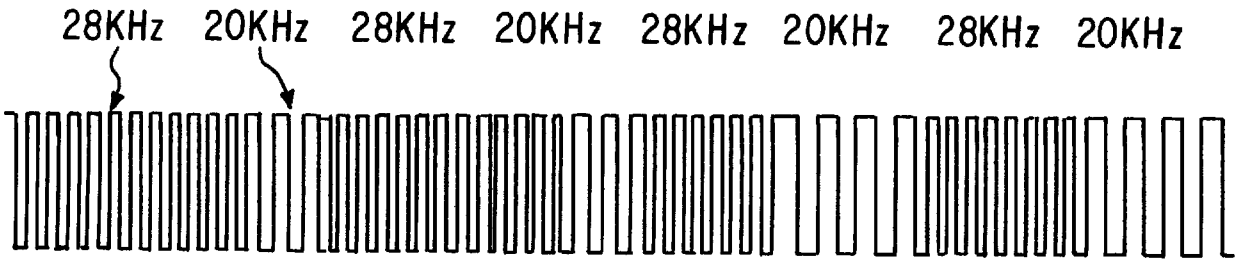
FIG. 7 is a graph showing operating characteristics of an ON time control circuit of FIG. 3.
Figure 7B:
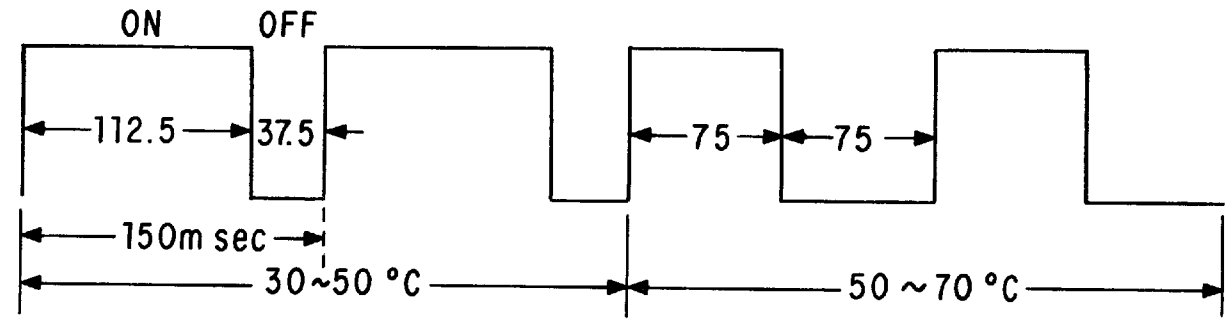

Referring to FIG. 3, the numeral 6 shows the earlier-mentioned thermistor. Designated by the numeral 65 is a temperature/voltage conversion circuit which converts a temperature signal fed from the thermistor 6 to a voltage signal. Operating characteristics of the temperature/voltage conversion circuit 65 are shown in FIG. 5. The ON time control circuit 66 sets a duty ratio, or the ratio of an ON signal period to a predetermined cycle time (150 msec. in this embodiment), in accordance with the output voltage of the temperature/voltage conversion circuit 65. As shown in FIG. 6, when the output voltage of the temperature/voltage conversion circuit 65 is 5 V (oil temperature 30° C.) or less, the duty ratio is set to 100%, whereby the ON time control circuit 66 continuously outputs an ON signal. When the output voltage is above 5 V but no more than 7.5 V (oil temperature 30° C. to 50° C.), the duty ratio is set to 75%, whereby ON signal and OFF signal periods become 112.5 msec. and 37.5 msec., respectively, as shown in FIG. 7. When the output voltage is above 7.5 V but no more than 10 V (oil temperature 50° C., to 70° C.), the duty ratio is set to 50%, whereby both ON signal and OFF signal periods become 75 msec. When the output voltage becomes 10 V (oil temperature 70° C.) or above, the duty ratio is set to 0%, whereby the ON time control circuit 66 continuously outputs an OFF signal. When transmitting a continuous OFF signal for 0% duty ratio to the switching circuits 63 (63*a*, 63*b*), the ON time control circuit 66 outputs a stop signal to the ON/OFF control circuit 69 at the same time.

Designated by the numeral 67 is a push-button switch which is pressed each time the ultrasonic cleaning machine is used. Designated by the numeral 68 is a timer on which a desired cleaning time can be set. The timer 68 transmits a start signal to the ON/OFF control circuit 69 when an ON signal is entered from the push-button switch 67, a stop signal when the set cleaning time elapses. The ON/OFF control circuit 69 transmits ON or OFF signals to the power amplifiers 64 (64*a*, 64*b*) in response to the start and stop signals received from the timer 68. The ON/OFF control circuit 69 turns off the power amplifiers 64 (64*a*, 64*b*) when the stop signal is entered not only from the timer 68 but also from the ON time control circuit 66 (when the oil temperature becomes 70° C. or above).

When a user turns on an unillustrated main switch, individual circuits including the oscillating circuits 61, 62 are energized and the ultrasonic cleaning machine becomes ready to operate. At this point, the thermistor 6 senses oil temperature. If the oil temperature is 35° C., for instance, the duty ratio is set to 75% so that the ON time control circuit 66 outputs an ON signal for a period of 112.5 msec. within each successive 150 msec. cycle time. During each ON signal period, the 28 kHz signal is supplied to the power amplifiers 64 (64*a*, 64*b*). Similarly, the ON time control circuit 66 outputs an OFF signal for a period of 37.5 msec. within each successive cycle time. The 20 kHz signal is supplied to the power amplifiers 64 (64*a*, 64*b*) during each OFF signal period. The 28 kHz and 20 kHz signals are therefore alternately fed into the power amplifiers 64 (64*a*, 64*b*) at a regularly recurrent duty cycle, as shown in FIG. 7.

When the push-button switch 67 is pressed, the timer 68 begins to count up and transmits a start signal to the ON/OFF control circuit 69. As a result, the ON/OFF control circuit 69 causes both of the power amplifiers 64 (64*a*, 64*b*) to turn on, whereby each ultrasonic transducer 5 (5*a*, 5*b*) is alternately driven by the 28 kHz and 20 kHz signals in accordance with the aforementioned duty ratio. When using the ultrasonic cleaning machine for removing dirt from fingernails, the user should soak his or her hands into the cleaning liquid X in the cleaning vessel 53 in such a manner that the fingernails are located at converging points of ultrasonic waves.

When the timer 68 reaches the set cleaning time, the ON/OFF control circuit 69 outputs a stop signal. Since the power amplifiers 64 (64*a*, 64*b*) are turned off at this point, the ultrasonic cleaning machine stops cleaning operation.

On the other hand, if the oil temperature reaches 50° C. due to heat buildup in the ultrasonic transducers 5 (5*a*, 5*b*) after prolonged cleaning operation, for instance, ultrasonic energy incident upon a unit surface area of an object to be cleaned exceeds a permissible level. In this case, ultrasonic energy emitted from the ultrasonic transducers 5 (5*a*, 5*b*) is suppressed to maintain a constant level of cleaning effect. More particularly, the duty ratio is set to 50% so that the ultrasonic transducers 5 (5*a*, 5*b*) are driven for shorter time periods at 28 kHz, and longer time periods at 20 kHz, compared to the duty ratio of 75%.

Should the oil temperature exceeds 70° C. during cleaning operation, the ON time control circuit 66 transmits a stop signal to the ON/OFF control circuit 69 and the cleaning operation is interrupted.

When the duty ratio is lowered, or when the time periods of 28 kHz transmission are reduced, the total output power from the ultrasonic transducers 5 (5*a*, 5*b*) decreases. The reason for the decrease in the output power is as follows. The ultrasonic transducers 5 (5*a*, 5*b*) resonate when driven at 28 kHz. They are not in a resonant condition when driven at 20 kHz. The ultrasonic transducers 5 (5*a*, 5*b*) have small impedance at the resonant frequency. Their impedance increases when the excitation frequency deviates from the resonant frequency. Since the power amplifiers 64 (64*a*, 64*b*) that drive the ultrasonic transducers 5 (5*a*, 5*b*) have a constant voltage characteristic, the input power to each ultrasonic transducer 5 (5*a*, 5*b*) decreases to about one fifth (⅕) when the excitation frequency is altered from 28 kHz to 20 kHz. The output power, or emitted ultrasonic energy, decreases accordingly. Provided that the input power to each ultrasonic transducer 5 (5*a*, 5*b*) is 100 W at 100% duty ratio, the input power at 0% duty ratio becomes 20 W, or one fifth of 100 W.

Generally, mean input power P [W] at a duty ratio of D% is given by the following equation:

$$\begin{aligned} P &= \{(\text{ON period} \times 100[W]) + (\text{OFF period} \times 20[W])\}/150 \\ &= D + (100 - D)/5 \end{aligned}$$

Thus, mean input power is 80 W when the duty ratio is 75%, 60 W when the duty ratio is 50%. If energy conversion efficiency of each ultrasonic transducer 5 (5*a*, 5*b*) is η, its output power is reduced from 100 ηW to 80 ηW and 60 ηW at 75% and 50% duty ratios, respectively. During OFF periods when each ultrasonic transducer 5 (5*a*, 5*b*) is driven at 20 kHz, its output power becomes 20 ηW. When the ultrasonic output power is reduced to such a low level, the cleaning effect decreases almost zero. As seen above, the cleaning effect decreases from 100% to 75% and 50% when the duty ratio is reduced from 100% to 75% and 50%, respectively.

It would be possible to alternately energize and de-energize the ultrasonic transducers 5 (5*a*, 5*b*) at a fixed frequency of 28 kHz at intervals equivalent to the earlier-mentioned ON and OFF cycle times rather than switching the excitation frequency between 28 and 20 kHz. In this case, mean input power to the ultrasonic transducers 5 (5*a*, 5*b*) can be arbitrarily varied by altering each successive energized or ON period. However, this form of intermittent activation is not preferable because parasitic oscillation occurs every time the ultrasonic transducers 5 (5*a*, 5*b*) are turned on and off.

It would be appreciated from the above discussion that the cleaning effect can be widely varied in a stable manner with the drive/control circuit of FIG. 3. On the other hand, if the viscosity of the oil Y is not affected to a great extent by its temperature, or if a satisfactory level of cleaning effect can be maintained with an adjustable range of 0 to 20%, a drive/control circuit having a simplified oil temperature compensating circuit for controlling power amplifiers like the example shown in FIG. 8 will be sufficient.

Figure 8:
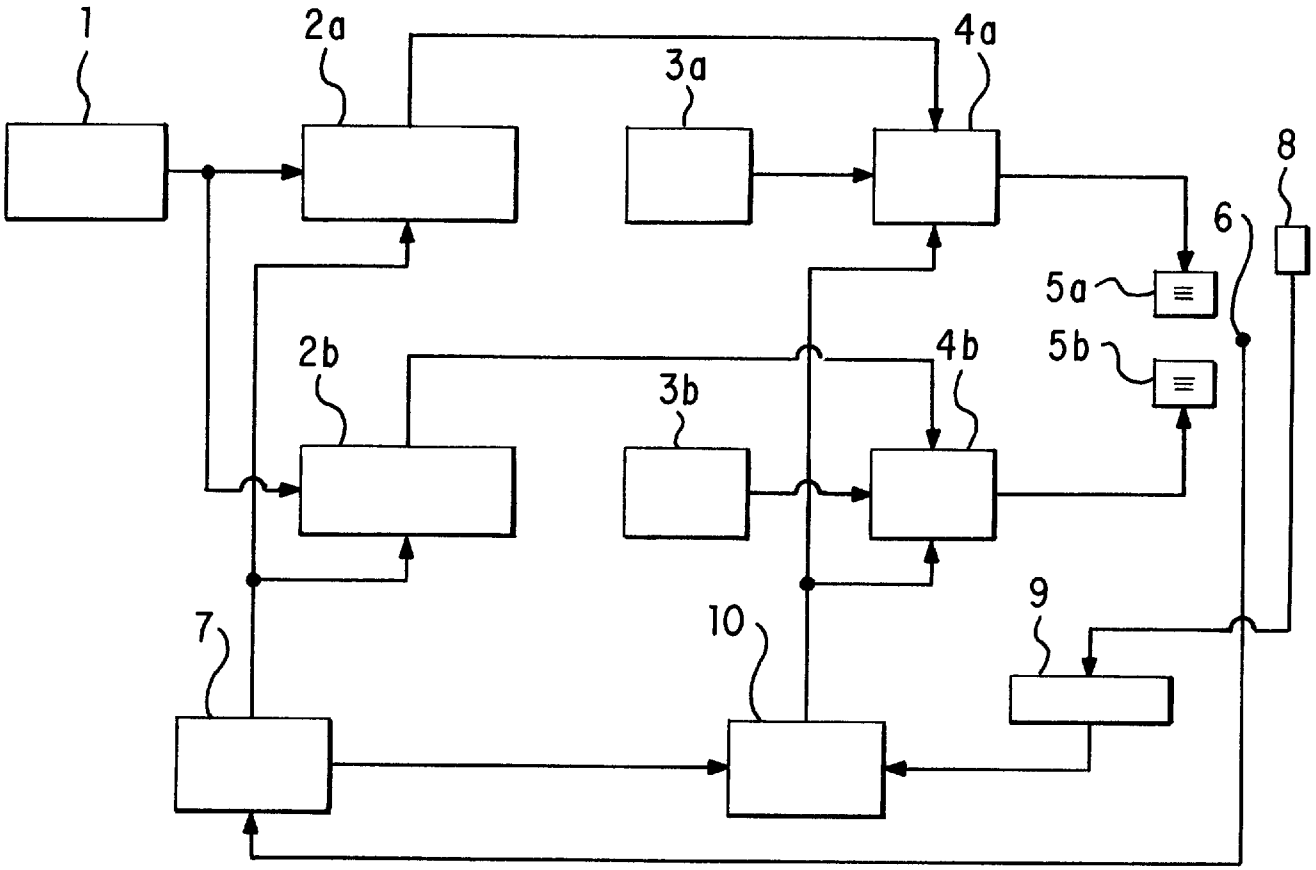
FIG. 8 is a block diagram showing an alternative drive/control circuit applicable to the ultrasonic cleaning machine shown in FIG. 2.

Referring to FIG. 8, designated by the numeral 1 is a power supply circuit for providing a line voltage to individual circuits of the ultrasonic cleaning machine as well as driving power to power controllers 2 (2*a*, 2*b*). Designated by the numeral 3 (3*a*, 3*b*) are oscillating circuits for generating an ultrasonic frequency of 28 kHz and designated by the numeral 4 (4*a*, 4*b*) are power amplifiers for amplifying the 28 kHz signal fed from the oscillating circuits 3 (3*a*, 3*b*) to provide increased output power. The power controllers 2 (2*a*, 2*b*) control collector voltage of final-stage transistors of the individual power amplifiers 4 (4*a*, 4*b*). Shown by the numeral 5 (5*a*, 5*b*) are ultrasonic transducers.

Designated by the numeral 6 is a thermistor and designated by the numeral 7 is an oil temperature compensating circuit. The oil temperature compensating circuit 7 controls the power controllers 2 (2*a*, 2*b*) to compensate for oil temperature variations based on temperature sensed by the thermistor 6 so that the collector voltage (and, accordingly, the output power) of the individual power amplifiers 4 (4*a*, 4*b*) is varied in accordance with characteristic lines graphed in FIG. 9.

Figure 9:
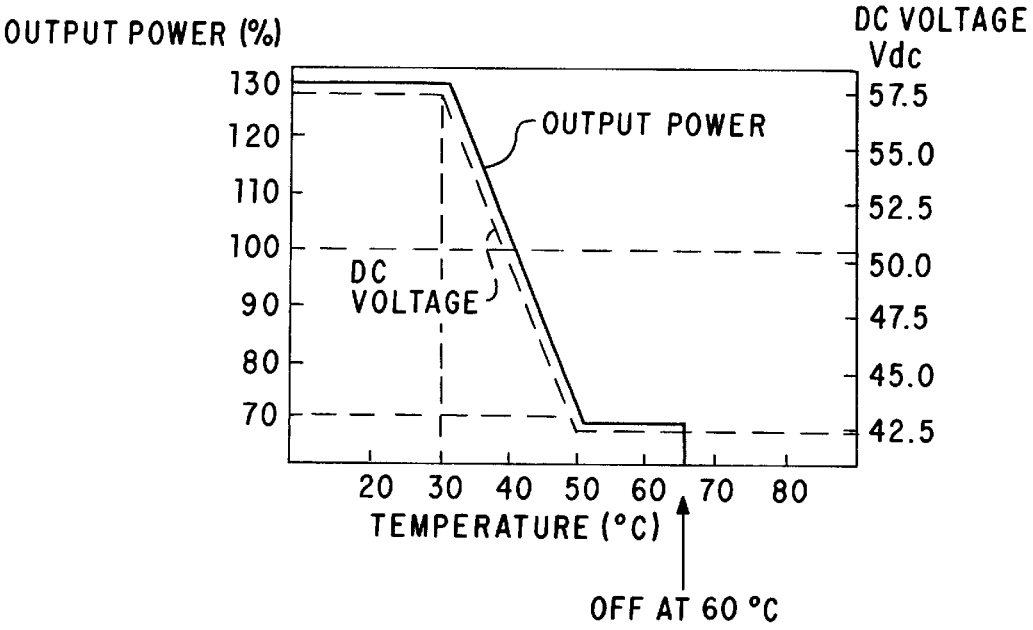
FIG. 9 is a graph showing operating characteristics of an oil temperature compensating circuit of FIG. 8.

In FIG. 8, designated by the numeral 8 is an infrared sensor for detecting a human hand when it is placed in the cleaning vessel 53. A pyroelectric-cell-type sensing device is used to prevent accidental detection of human body in the proximity. The infrared sensor 8 is mounted on the periphery of the cleaning vessel 53 shown in FIG. 2, for instance. Designated by the numeral 9 is a timer on which a desired cleaning time can be set. The timer 9 transmits an ON signal when a detection signal is entered from the infrared sensor 8, an OFF signal when the set cleaning time elapses. Indicated by the numeral 10 is an ON/OFF control circuit which activates and deactivates the power amplifiers 4 (4*a*, 4*b*) in accordance with the ON and OFF signals fed from the timer 9. The ON/OFF control circuit 10 automatically turns off the power amplifiers 4 (4*a*, 4*b*) when the oil temperature reaches 65° C. and a specific signal is transmitted from the oil temperature compensating circuit 7, as shown in FIG. 9.

According to the drive/control circuit of FIG. 8, if the oil temperature within the external tank 51 is 30° C. or less, the power amplifiers 4 (4*a*, 4*b*) are driven at 130% of their normal input power, and when the oil temperature rises beyond 30° C., the output power of the power amplifiers 4 (4*a*, 4*b*) is reduced, as shown in FIG. 5. With this arrangement, ultrasonic energy incident upon a unit surface area of human hands soaked in the cleaning liquid X is regulated to a constant level.

Since the drive/control circuit of FIG. 8 is provided with the infrared sensor 8 which works as a proximity switch, there is no need to operate any ON/OFF switch with a wet hand. This is convenient when the ultrasonic cleaning machine has a double-washbowl cleaning vessel as in the example of FIG. 2.

Figure 10:
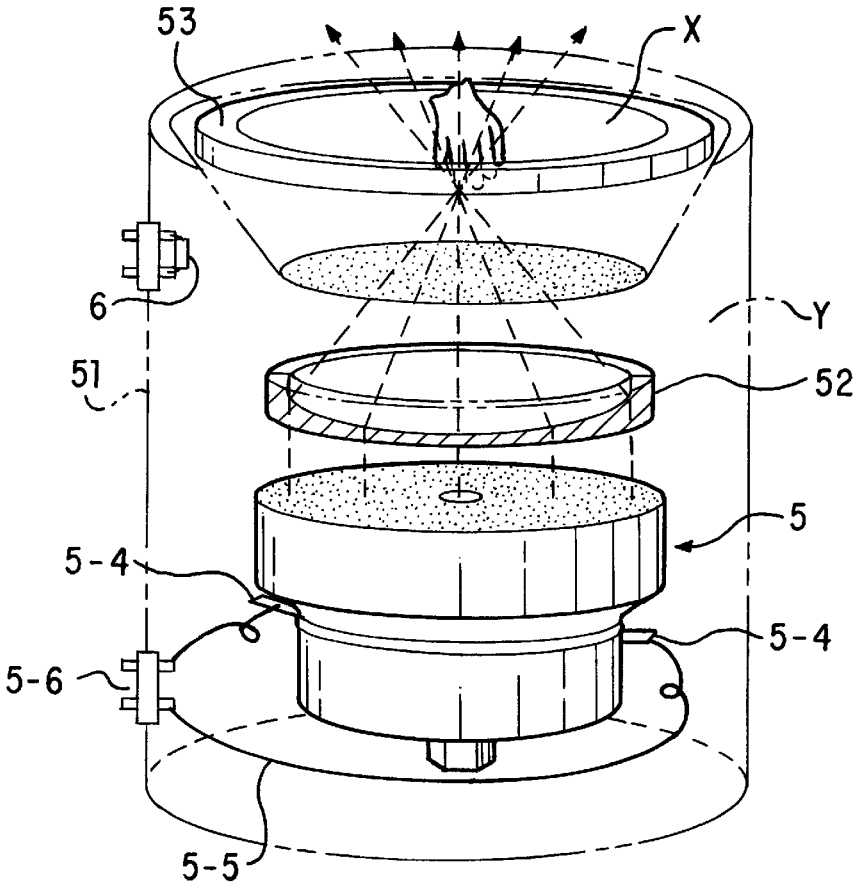
FIG. 10 is a perspective view showing a modified form of the ultrasonic cleaning machine of FIG. 2 according to a second embodiment of the invention.

Although the embodiment of FIG. 2 employs a double-washbowl configuration comprising a pair of ultrasonic transducers 5 (5*a*, 5*b*) and to allow simultaneous cleaning of both hands, it may be modified to a single-washball configuration (second embodiment) as shown in FIG. 10 if it is not required to clean both hands at the same time.

In FIGS. 2 and 10, each acoustic lens 52 is provided at a certain distance from the radiating surface (or the upper end face) of the associated ultrasonic transducer 5. Naturally, there is the need for a support mechanism for retaining each acoustic lens 52 in position. From this, it would be recognized that if this lens retaining mechanism is constructed to enable up/down movements of the acoustic lens 52, it is possible to move the converging point of ultrasonic waves, or the point of maximum cleaning effect, to a desired position depending on the shape of the cleaning vessel 53 or the type of objects to be cleaned.

Figure 11:
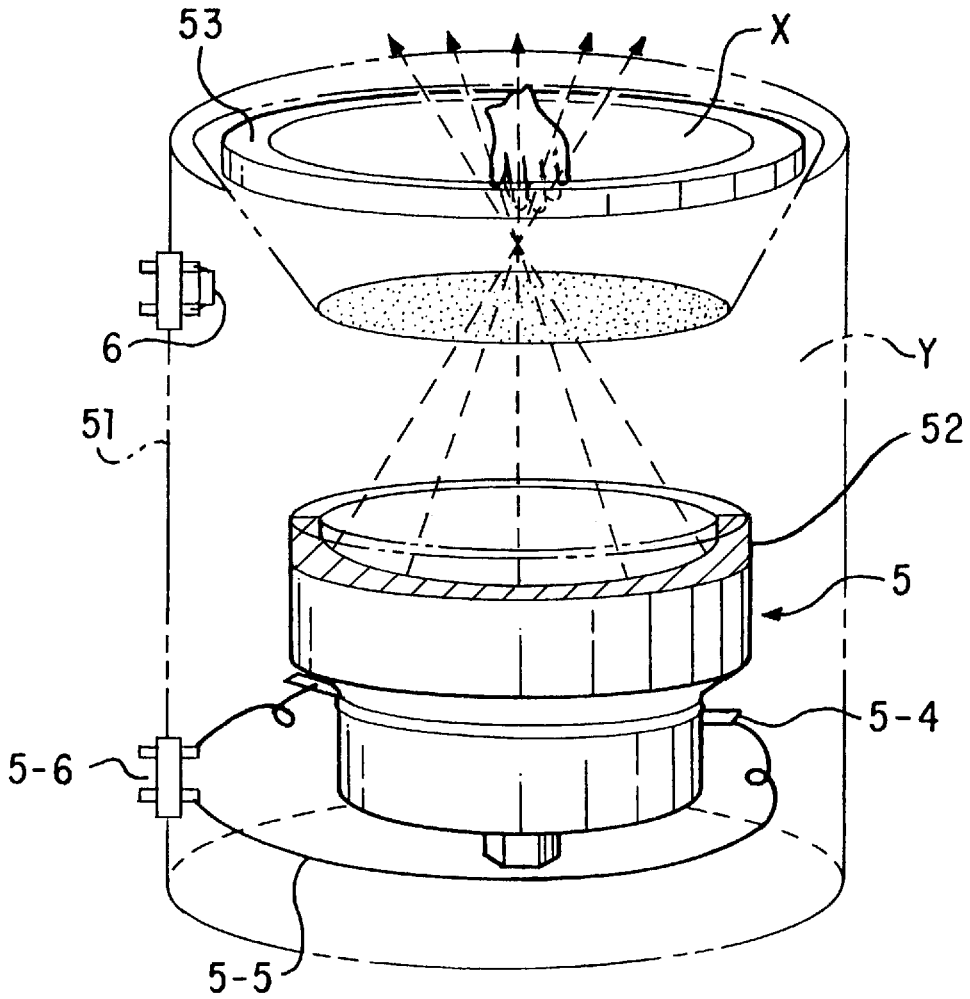
FIG. 11 is a perspective view showing a third embodiment of the invention.

FIG. 11 is a diagram showing one variation of the ultrasonic cleaning machine of FIG. 10 according to a third embodiment of the invention, in which the acoustic lens 52 is mounted in direct contact with the radiating surface of the ultrasonic transducer 5. In the embodiment of FIG. 11, the point of maximum cleaning effect (or the converging point of ultrasonic waves) within a cleaning liquid in the cleaning vessel 53 is set to 60 mm. This configuration is advantageous in that the machine structure can be simplified because the lens retaining mechanism is not required at all. Although the acoustic lens 52 may vibrate producing quite a small sound within the audible frequency range, the sound will never leak to the outside passing through the oil Y and external tank 51.

Figure 12:
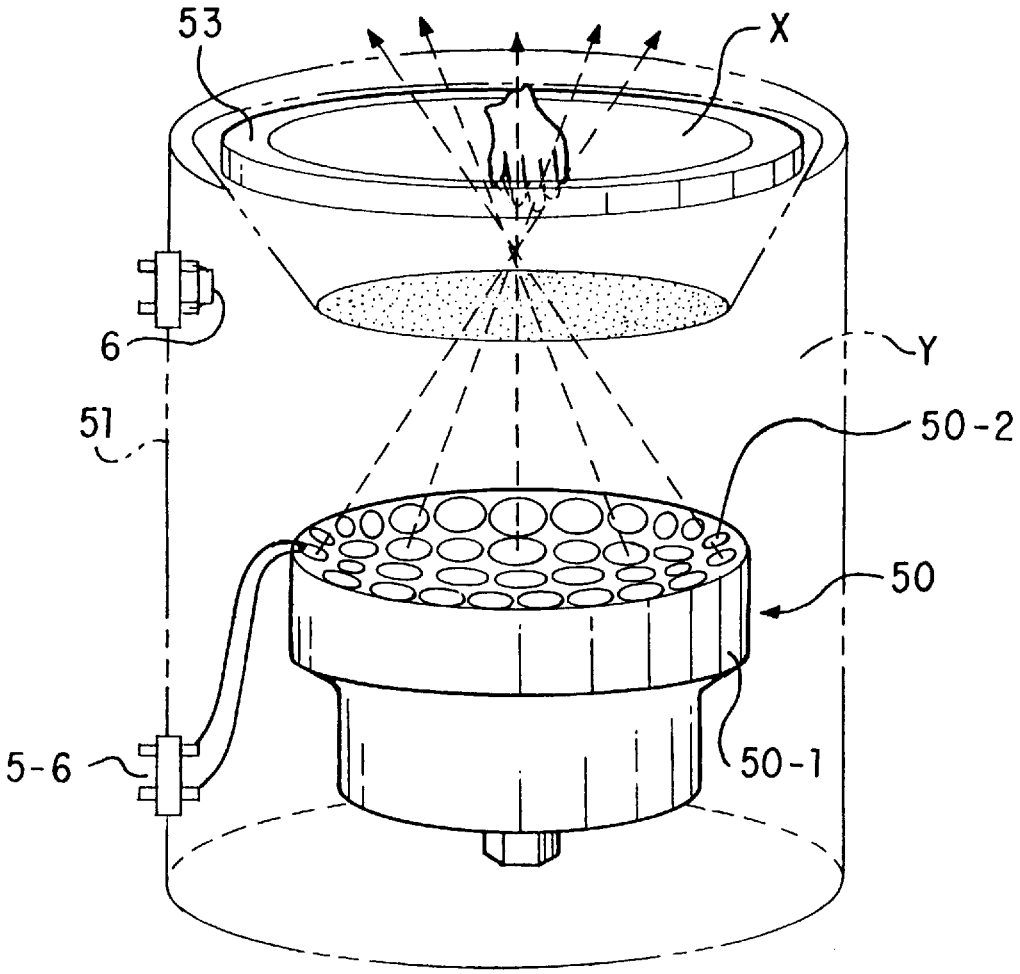
FIG. 12 is a perspective view showing a fourth embodiment of the invention.

FIG. 12 is a perspective view showing a fourth embodiment of the invention. This embodiment employs, instead of the vibrating elements 5-1 and acoustic lenses 52 of the foregoing embodiments, an ultrasonic transmitting and converging device 50 for simultaneously emitting and converging ultrasonic waves. The ultrasonic transmitting and converging device 50 comprises an array block 50-1 having a concave upper surface and a plurality of circular vibrating elements 50-2 arranged on the upper surface of the array block 50-1. According to this configuration, the expensive acoustic lens 52 is not required at all and the overall construction of the ultrasonic cleaning machine is simplified.

Advantages of providing the independent cleaning vessel 53 for holding the cleaning liquid X besides the external tank 51 as shown in FIGS. 2, 10, 11 and 12 are as follows:

(1) It is possible to reduce the amount of the cleaning liquid X to be replaced at one time when it has been contaminated after repeated use. It should be noted that the oil Y within the external tank 51 need not be replaced.

(2) A liquid having high transmitting efficiency can be employed as a medium for propagating ultrasonic vibrations produced by the ultrasonic transducers 5 or ultrasonic transmitting and converging device 50.

(3) It is possible to eliminate the need to insulate the terminals 5-4, lead wires 5-5 and outlet terminals 5-6 of the ultrasonic transducers 5 by using insulating oil as a transmitting medium.

(4) The cleaning vessel 53 may be made of a plastic material, instead of a metallic material, and can be formed into an optimum shape depending on the shape of objects to be cleaned.

The invention is also applicable to such ultrasonic cleaning machines that hold a cleaning liquid X directly in an external tank 51 as is the case with the conventional ultrasonic cleaning machines.

Figure 13:
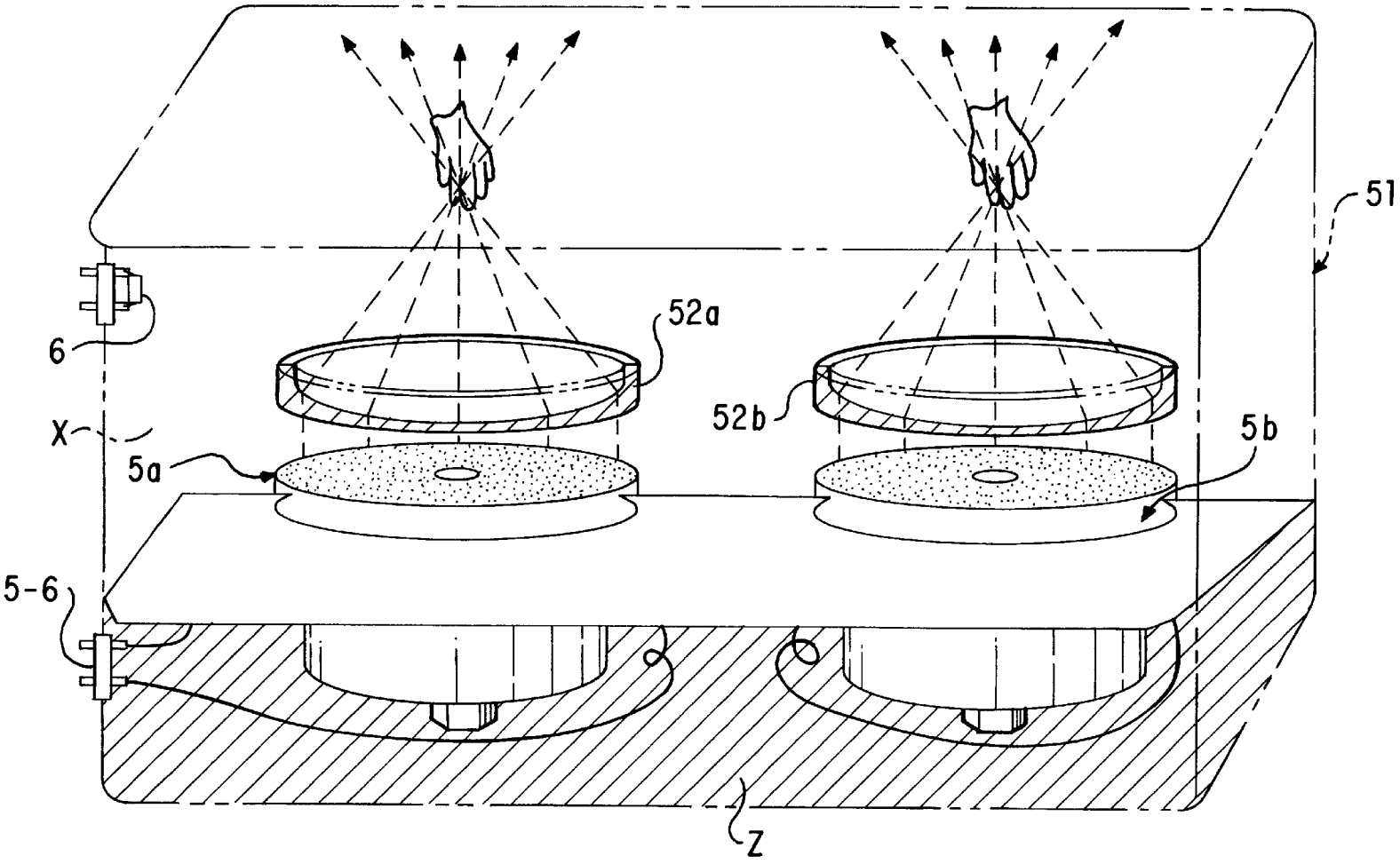
FIG. 13 is a perspective view showing a fifth embodiment of the invention.

FIG. 13 shows this type of ultrasonic cleaning machine as a fifth embodiment of the invention. According to the configuration of FIG. 13, the cleaning liquid X, which is generally electrically conductive, is filled directly in the external tank 51. It is therefore necessary to insulate electric connections around the individual transducers 5. For this reason, transducer terminals 5-4, lead wires 5-5 and outlet terminals 5-6 are insulated by filling an insulating material Z around the lower section of each transducer 5. Since the insulating material Z is required to have good thermal conductivity for accelerating heat dissipation from the transducers 5, a molding resin is used in this embodiment.

Figure 14:
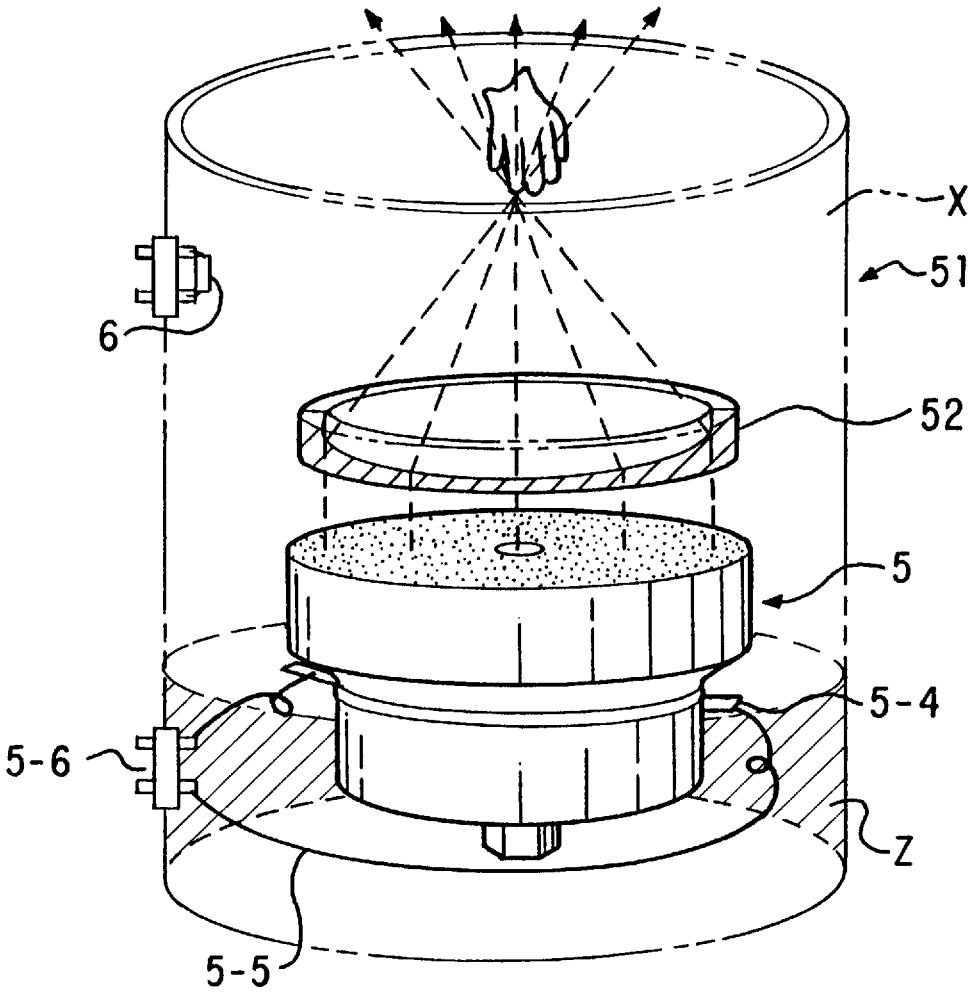
FIG. 14 is a perspective view showing a modified form of the ultrasonic cleaning machine of FIG. 13 according to a sixth embodiment of the invention.

FIG. 14 shows a sixth embodiment of the invention, which is a modification of the fifth embodiment. This is a single-washball version (comprising one each transducer 5 and acoustic lens 52) of the ultrasonic cleaning machine of FIG. 13.

FIG. 15 shows a seventh embodiment of the invention, which is a modification of the sixth embodiment of FIG. 14. In this embodiment, the acoustic lens 52 is in direct contact with the ultrasonic transducer 5.

Advantages of holding the cleaning liquid X directly in the external tank 51 as seen in FIGS. 13, 14 and 15 are as follows:

(1) Since a low-viscosity cleaning liquid is used as a medium for ultrasonic waves, ultrasonic propagation characteristics are almost unaffected by changes in the liquid temperature. Therefore, the drive/control circuit of FIG. 8 is suited for this configuration except that the thermistor 6 and oil temperature compensating circuit 7 are not necessary. Furthermore, it is also possible to eliminate the power controllers 2, resulting in simplification of the drive/control circuit.

(2) Mechanical construction of the ultrasonic cleaning machine can be much simplified. (In the configuration using oil as a propagation medium, an arrangement for sealing an oil-containing tank is inevitably required.)

What is claimed is:

1. An ultrasonic cleaning machine comprising:

an external tank holding an insulating oil;

an ultrasonic transmitting device immersed in the insulating oil;

a cleaning vessel holding a cleaning liquid, said cleaning vessel being partially submerged in the insulating oil;

an ultrasonic wave focusing means, totally immersed in said insulating oil and suspended above said ultrasonic transmitting device and under said cleaning vessel, for focusing ultrasonic waves produced by said ultrasonic transmitting so as to converge within the cleaning liquid in the cleaning vessel.

2. An ultrasonic cleaning machine according to claim 1 further comprising:

a power controller for controlling output power radiated by said ultrasonic transmitting device by outputting a control output to said ultrasonic transmitting device;

a temperature sensor for sensing temperature of the insulating oil; and said power controller being responsive to an output from said temperature sensor so as to compensate said control output in accordance with a temperature of said insulating oil to provide a constant cleaning effect in said cleaning liquid regardless of oil temperature variations.

3. An ultrasonic cleaning machine comprising:

an external tank holding an insulating oil;

an ultrasonic transducer immersed in the insulating oil;

an acoustic lens fixed above and apart from a radiating surface of said ultrasonic transducer, wherein said radiating surface of said acoustic lens is immersed in said insulating oil; and a cleaning vessel holding a cleaning liquid, said cleaning vessel being partially submerged in the insulating oil and above said acoustic lens such that focusing characteristics of said acoustic lens determined by said acoustic lens and acoustic characteristics of said insulating oil direct ultrasonic waves produced by said ultrasonic transducer through a bottom of said cleaning vessel to converge within the cleaning liquid.

4. An ultrasonic cleaning machine comprising:

an external tank holding an insulating oil;

a cleaning vessel holding a cleaning liquid, said cleaning vessel being partially submerged in the insulating oil; an ultrasonic transmitting and converging device immersed in the insulating oil and focusing ultrasonic waves to converge within the cleaning liquid;

a pair of signal generators for generating signals of two different frequencies which are used to control output power radiated by said ultrasonic transmitting and converging device;

a temperature sensor for sensing a temperature of the insulating oils; and means for controlling the signals of the two different frequencies for driving said ultrasonic transmitting and converging device such that said two different frequencies are alternately chosen based on a duty ratio set in accordance with said oil temperature to provide a constant cleaning effect regardless of oil temperature variations.

* * * * *